US006446418B1

(12) United States Patent
Maekawa et al.

(10) Patent No.: US 6,446,418 B1
(45) **Date of Patent: *Sep. 10, 2002**

(54) PACKAGING DEVICE

(75) Inventors: Mikio Maekawa; Mitsuharu Ikeda, both of Itami (JP)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/675,255

(22) Filed: Sep. 29, 2000

Related U.S. Application Data

(63) Continuation of application No. 09/244,992, filed on Feb. 4, 1999.

(30) Foreign Application Priority Data

Feb. 10, 1998 (JP) ..... H10-27895

(51) Int. Cl.[7] ..... B65B 27/00

(52) U.S. Cl. ..... 53/588; 53/204; 53/556; 100/27

(58) Field of Search ..... 53/588, 566, 204; 100/27

(56) References Cited

U.S. PATENT DOCUMENTS

| | | | | |
|---|---|---|---|---|
| 3,116,032 A | | 12/1963 | Roberts | |
| 3,348,787 A | | 10/1967 | Giles | |
| 3,486,293 A | | 12/1969 | Van De Bilt | |
| 4,284,031 A | | 8/1981 | Del Pozo | |
| 4,761,934 A | * | 8/1988 | Lancaster | 53/399 |
| 4,829,753 A | * | 5/1989 | Bricmont | 53/588 |
| 4,866,909 A | | 9/1989 | Lancaster et al. | |
| 5,174,846 A | * | 12/1992 | Bate et al. | 156/185 |
| 5,282,347 A | | 2/1994 | Cleine et al. | |
| 5,311,725 A | | 5/1994 | Martin et al. | |
| 5,829,234 A | | 11/1998 | Suolahti | |

FOREIGN PATENT DOCUMENTS

| | | | |
|---|---|---|---|
| DE | 2256708-4 | * | 5/1974 |
| EP | 0 044 627 | | 1/1982 |
| EP | 0 225 665 | | 6/1987 |
| EP | 0 544 312 | | 6/1993 |
| JP | 5-294314 | | 11/1993 |

* cited by examiner

*Primary Examiner*—Rinaldi I. Rada
*Assistant Examiner*—Thanh Truong
(74) *Attorney, Agent, or Firm*—Lowe Hauptman Gilman & Berner, LLP

(57) ABSTRACT

A circular track (11) constructed to open and close supports a truck (4) riding on the track (11). A packaging material feeder (7) is mounted on the truck (4) to feed packaging material (6) from a packaging material coil (5). Part of the item for packaging (8) is placed in the closed circular track (11) and is supported by means of a support (9). A drive mechanism for moving the truck (12) is set along the circular track (11) and is engaged with the truck (4) . The drive mechanism is operated with a motor stationarily mounted to the track to move the truck along the circular track (11). There is no need to mount the motor to the truck. Accordingly, it is possible to make the truck compact and decrease the curvature radius of each corner of the circular track. This results in the possibility of wrapping a relatively large item for packaging and at the same time make a packaging device simple and compact in its entirety.

16 Claims, 4 Drawing Sheets

PACKAGING DEVICE

This application is a continuation of Ser. No. 09/244,992, filed Feb. 4, 1999.

BACKGROUND OF THE INVENTION

1. Field of the Invention

The present invention concerns a packaging device, used to package or tie together steel plate wrapped coils, steel bundles and the like, by tying a packaging material around the surface of the item for packaging, so that the item for packaging can be easily handled and in order to prevent the item for packaging from getting dirty. Specifically, the invention concerns a packaging device which, on the one hand, can be used for packaging relatively large items for packaging, yet its structure is simple and can be miniaturized.

2. Description of the Prior Art

In the past, packaging devices of steel plate wrapped coils included, for example, the device disclosed in Japanese Patent Application 5-294314, which consisted of a circular track, forming a closed route, and constructed so that one part thereof can open and close. A means of feeding a packaging material was mounted on a truck revolving on top of the above-mentioned circular route. To which feed the packaging material from a packaging material coil, a means of support, which can support the item for packaging and whose one part was closed and which is set in the above-mentioned circular route.

According to the above-mentioned existing technology, as shown, for example in, FIG. 3, a truck (51) is set so that it can pass inside the steel plate wrapped coil, which is the item for packaging, while a motor (52) and a current collector (53) are mounted on a the truck (51). Conductive rails (55) are arranged along a circular track (54), to supply electric power, via the current collector (53), to motor (52), to run the truck (51).

In addition, because the distance between the item for packaging and the truck (51), surrounding its circumference, varies from one time to another, a tension accumulator (58) is installed on the truck (51), in order to prevent slackening of the packaging material (57) delivered from the packaging material coil (56), which is on the truck (51), when this distance narrows.

In other words, several stationary guide rollers (59) and several swinging guide rollers (60) are arranged, and if the swinging guide rollers (60) move away from the stationary guide rollers (59), the packaging material (57), which revolves the guide rollers (59,60) and moves along a curved route, is slackened and thus the swinging guide rollers (60) applies a constant tension to the packaging material (57), as it moves away.

The above-mentioned existing packaging device has the following problems.

(1) Because the motor is installed in the truck, the truck must be large, and in order to enable this truck to revolve smoothly, the radius of curvature in the corners has to be large likewise, the circular track has to be large, and the whole packaging device become enlarged. In addition, because the conductive rails are laid along the circular track, electrical leak counter-measures have to be sufficiently installed to maintain operator safely, and the whole packaging device is therefore enlarged also for this reason.

(2) In the tension accumulator, which consists of several stationary guide rollers and several swinging guide rollers, in addition to an urging means, in order for the swinging guide rollers to move smoothly, space has to be created on the truck, and the truck has to be enlarged even more. As a result, the circular track has to be enlarged and the whole packaging device is further enlarged.

In addition, although it may seem that by increasing the number of guide rollers, the movement distance of the above-mentioned swinging guide rollers can be decreased, in such a case, the resistance produced between the guide rollers and the packaging material increases, the smooth movement of the swinging guide rollers is interrupted, and especially in devices wherein the truck revolves at a high speed, they cannot respond quickly to rapid changes in the tension of the packaging material.

SUMMARY OF THE INVENTION

The present invention solves the above-mentioned problems with a simple and compact packaging device which can be used for packaging relatively large items for packaging.

In order to solve the above-mentioned problems, the present invention proposes a packaging device equipped with a closed track constructed so that at least one part thereof can open and close, a truck, which revolves on top of the track, a means of feeding a packaging material from a packaging material coil, which is mounted on the above-mentioned truck and is supported so that it can rotate, and means of support, which can support an item for packaging while at least one part of the item for packaging is arranged in the above-mentioned closed in accordance with this track invention, a means of driving the truck, which follows the above-mentioned truck is installed therein, and this means of driving the truck and the above-mentioned truck are constructed so that they can be linked, and by driving this means of driving the truck, the above-mentioned truck can revolve along the above-mentioned.

As the means of driving the above-mentioned truck, a means of transmitting, which endlessly circulates along the circular track, is provided such as a serrated toothed belt and a chain, or the like, can generally be used, but this means of transmitting can also be made of numerous driving gears, driving rollers or the like, distributed along the circular track.

In addition, the above-mentioned means of driving the truck can drive the truck while it is detachably and directly connected to the passive part set in the truck, or, for example, it can be interlocked with passive gears, set in the truck, and the truck can be driven through a mobile connection between these passive gears and driving gears, engaged with a rack which is set in the circular track.

Moreover, the packaging device, of the present invention, can be called a device for wrapping a sheet material or tape around the object articles, and the present invention includes not only a device for packaging the object articles, but also a device for tying the object articles, in other words, a tying device.

Since the first aspect is constructed as above, by causing the means of running the truck to rotate along the track, it and the moving truck revolve on the track, and the packaging material is drawn from the packaging material coil and wrapped around the item for packaging by the means of feeding the packaging material, which is mounted on the truck. As a result, the first aspect has the following advantages.

(A) The truck engages with a means of running the truck and is caused to revolve therealong. Therefore, a means of running the truck, such as a motor, which was needed in the above-mentioned past technology, does not have to be mounted on the truck, and the truck can be miniaturized. As a result, the corners of the track can be made with a small radius of curvature, and although the device can be used for packaging relatively large items for packaging, the whole packaging device can be miniaturized.

In addition, because exposed wiring, such as conductive rails, which were required in the above-mentioned past technology, are not installed, electrical leak countermeasures can be eliminated, which also makes it possible to miniaturize the whole packaging device.

In addition, a second aspect of the present invention proposes a packaging device, which is a packaging device equipped with a means of feeding a packaging material, constructed so that it can feed a packaging material from a packaging material coil, which is supported so that it can rotate around the shaft center, and which is characterized by the fact, that the above-mentioned packaging material coil is connected with mobility, via a torque limiter, to a drive generator, which applies a rotarty force in the direction opposite to the direction in which the packaging material is fed, so that, if the rotary force generated by drawing the packaging material from the packaging material coil, decreases below a set value, this packaging material coil can rotate in the opposite direction.

Since the second aspect is constructed as above, if the tension of the packaging material decreases as a result of a decrease in the length of the packaging material drawn from the packaging material coil, until it is wrapped around the item for packaging, the rotary force produced by the drive generator is transmitted to the packaging material coil, and the packaging material coil rotates in the opposite direction and applies tension to the packaging material.

On the other hand, by being wrapped around the item for packaging, a tension exceeding a set value is applied to the packaging material, drawn from the packaging material coil, and the rotary force from the drive generator is interrupted by the rotary force limiter, and the packaging material is thus smoothly fed from the packaging material coil. As a result, the second aspect has the following advantage.

(B) The drive generator is connected, with mobility, to the packaging material coil and tension control rollers, via a torque limiter, and a set tension can therefore be applied to the packaging material. Therefore, there is no need to install the numerous swinging guide rollers, used in the above-mentioned past technology, and the whole packaging device can be simplified and miniaturized.

In addition, a third aspect of the present invention proposes a which is packaging device equipped with a means of feeding a packaging material control roller is installed between the packaging material coil and the item for packaging, which is wrapped by the packaging material, fed from the packaging material coil, that the tension control roller is constructed so that it can be rotated by the passage of the packaging material along the surface of the tension control roller. The tension control roller is connected with mobility, via a torque limiter, to a drive generator, which applies a rotary force in the direction opposite to the direction in which the packaging material passes the above-mentioned tension control roller, so that, if the tension of the packaging material (6), which passes the surface of the tension control roller (14), decreases below a set value, this tension control roller (14) can rotate in the opposite direction.

Since the third aspect is constructed as above, when the packaging material, fed by from the packaging material coil, passes, a tension control roller rotates as a result of the friction with the packaging material. In addition if the tension, applied by the packaging material as it wraps around the item for packaging decreases below a set value, the tension control roller rotates in the opposite direction and the packaging material rewinds, causing the tension of the packaging material to be maintained over the set value. Moreover, if the tension applied by the packaging material as it wraps around the item for packaging exceeds a set value, the rotary force produced by the drive generator is interrupted by the rotary force limiter, and the packaging material is thus smoothly fed from the packaging material coil. As a result, the third aspect has the following advantage in addition to that of the second aspect.

(C) A drive generator, which applies a rotary force in the opposite direction, is connected with mobility via torque limiters to the tension control rollers, set between the packaging material coil and the item for packaging, and a constant tension can therefore be applied to the packaging material, regardless of the consumption of the packaging material.

The packaging devices, pertaining to the above-mentioned second and third aspects, can be applied to packaging devices which wrap a packaging material around an item for packaging by fixing a means of feeding the packaging material and causing the item for packaging to be self-run. The packaging devices pertaining to the second and third aspects, however, can be applied also to the packaging device such as the first aspect which cause a truck, on which the means of feeding the packaging material is mounted, to revolve along a circular track. In addition, in such a case, as described in the first aspect, the truck can be driven by a means of running the truck, which is set along the circular track, or the truck can be made to self-run by means of a motor, which is mounted on the truck and is supplied electricity from conductive rails, arranged along the track.

In addition, as the drive generator used in the packaging device pertaining to the above-mentioned second and third aspects, a drive generator for exclusively reverse rotation can be installed, but in the case that the above-mentioned means of feeding the packaging material is mounted on the truck and causes it to revolve around the circumference of the item for packaging, it is recommended to utilize this drive generator, which can cause the truck to revolve. If the truck revolution speed is increased, the changes in the distance between the packaging material coil and the item for packaging become sharp and slack can be rapidly produced. By utilizing the drive generator which causes the truck to revolve, therefore, the slack produced by the above-mentioned changes in distance can be quickly absorbed in response to the speed of the truck.

DETAILED DESCRIPTION OF THE PREFERRED EMBODIMENTS

An embodiment of the present invention will now be described, based on figures.

Figure 1:
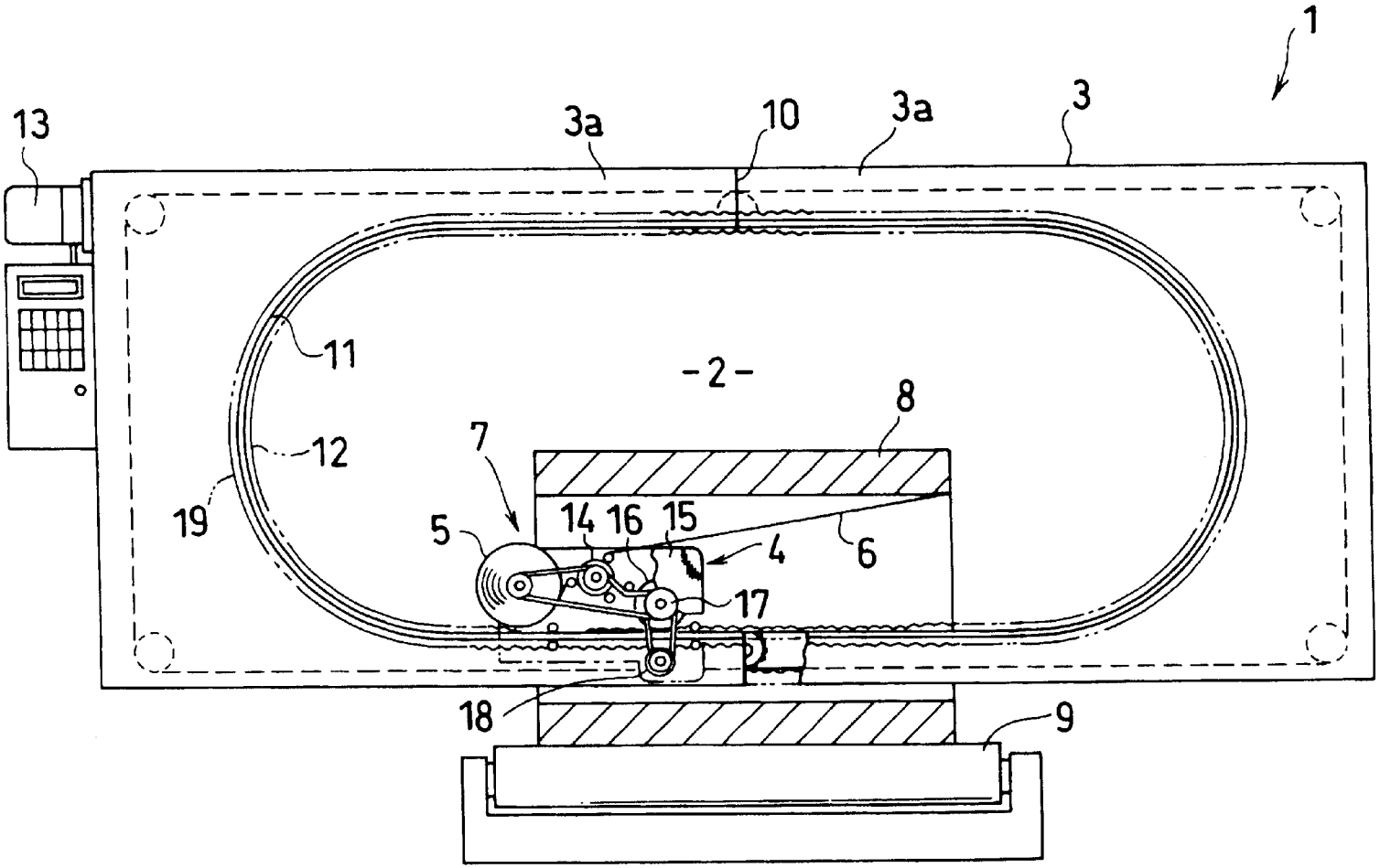
FIG. 1 is a front cutaway view of the packaging device, showing an embodiment of the present invention.

As shown in FIG. 1, packaging device (1) is equipped with a frame (3), in which a holding space for the item for packaging (2) is set, a truck (4), which revolves around the circumference of the holding space for the item for packaging (2), a means of feeding a packaging material (7), which feeds a packaging material (6) from a packaging material coil (5), which is mounted on the (4), and a means of support (9), which supports the steel plate wrapped coil, which is the item for packaging (8).

The frame (3) is comprised of two U-shaped half-frames (3*a*/3*a*), set so that their open sides (10) face each other, and a circular track (11), which forms a closed route along the inner rim of the front and back sides of the frame (3).

Each of the U-shaped half-frames (3*a*/3*a*) are made so that they can connect and disconnect, to the right and left, in FIG. 1, and by connecting and disconnecting, the circular route (11) opens and closes in the center.

In addition, the carrying-in and carrying-out of the steel plate wrapped coil (8) is done with the circular track (11) in the open state. In the carrying-in state, shown in FIG. 1, only the upper part of the steel plate wrapped coil (8) is placed in the circular track (11). In other words, in a state in which the circular track (11) is inserted inside the steel plate wrapped coil (8), the steel plate wrapped coil is supported by the means of support (9).

In addition, in this embodiment, the circular route (11) is constructed so that it can open and close by causing the two U-shaped half-frames (3*a*/3*a* ) to mutually connect and disconnect, but the circular route pertaining to the present invention can also open and close by movement of only one part of the frame, such as by a parallel movement or a swinging movement, and the like.

Figure 2:
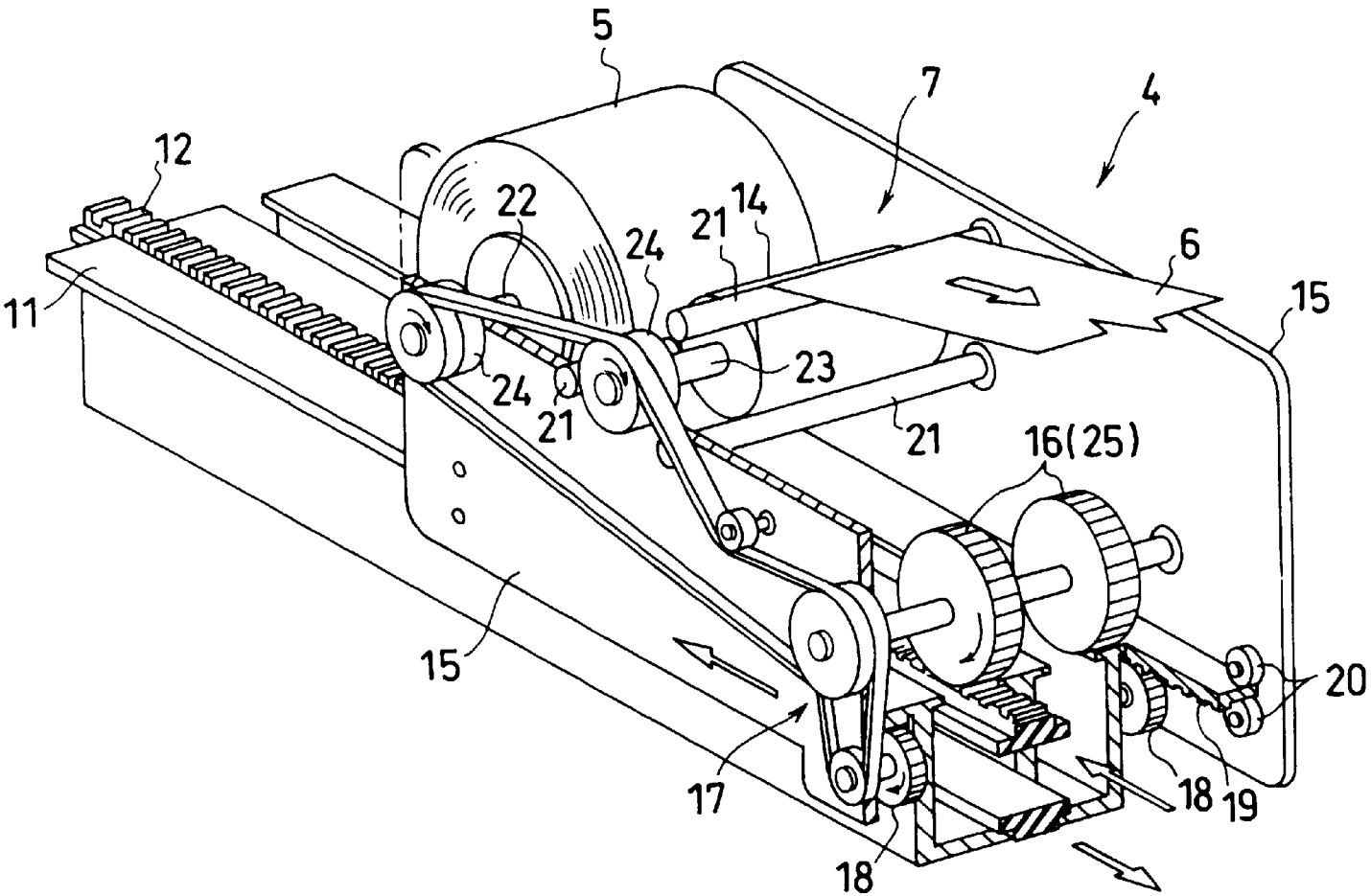
FIGS. 2 and 4 are front cutaway views of the truck positioned on right hand side and left hand side half frames of the packaging device.
Figure 3:
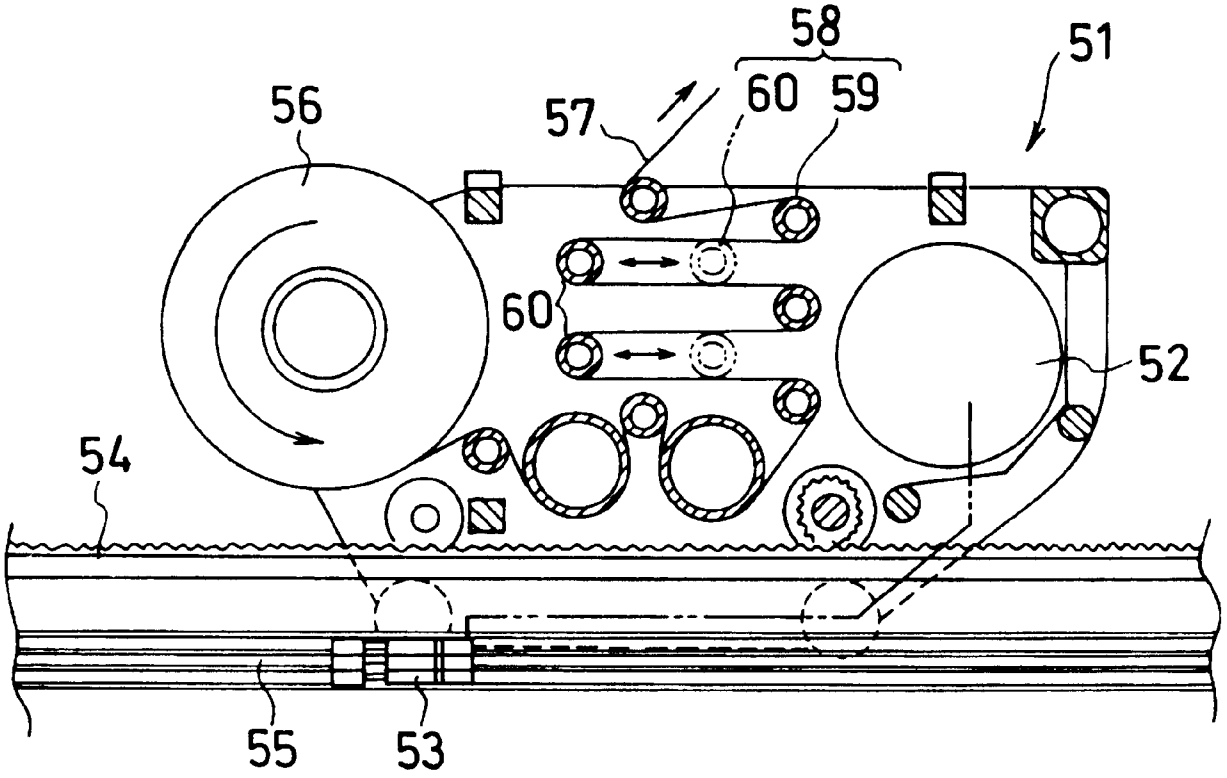
FIG. 3 PRIOR ART
FIG. 3 is a front cutaway view of the truck, showing the prior art.

As shown in FIGS. 1 and 2, in the U-shaped half-frame (3*a*), a serrated toothed belt (12), which rotates on the inner side and outside of it, is installed as a means of driving the truck. When the serrated toothed belt (12) rotates, under the action of a motor (13), it is caused to interlock with the truck (4), and the driving force of the serrated toothed belt (12) thus causes the truck (4) to revolve along the circular track (11).

The packaging material (6), fed from the packaging material coil (5), is gradually drawn from the packaging material coil (5) as the truck revolves on the circular track (11), and after it passes the circumference of the tension control roller (14), it is wrapped around the steel plate wrapped coil.

The steel plate wrapped coil (8) is rotated and at the same time supported by the means of support (9), and therefore, the packaging material (6) spirally wraps the inside and outside of the steel plate wrapped coil (8) and the packaging is completed within one rotation of the steel plate wrapped coil (8) on the means of support (9).

As shown in FIG. 2, in the truck (4), passive gears (16) are supported, with mobility, between two side frames (15/15), and the serrated toothed belt (12) engages with these passive gears. The passive gears (16) are connected with mobility to driving gears (18) via transmission mechanisms (17), located on the outside of the side frames (15). These driving gears (18) engage with a rack (19), formed in the outer surface of the circular track (11), and the driving force of the above-mentioned serrated toothed belt (12) is transmitted from the passive gears (16) to the driving gears (18), thereby causing the truck (4) to revolve along the circular track (11).

Figure 4:
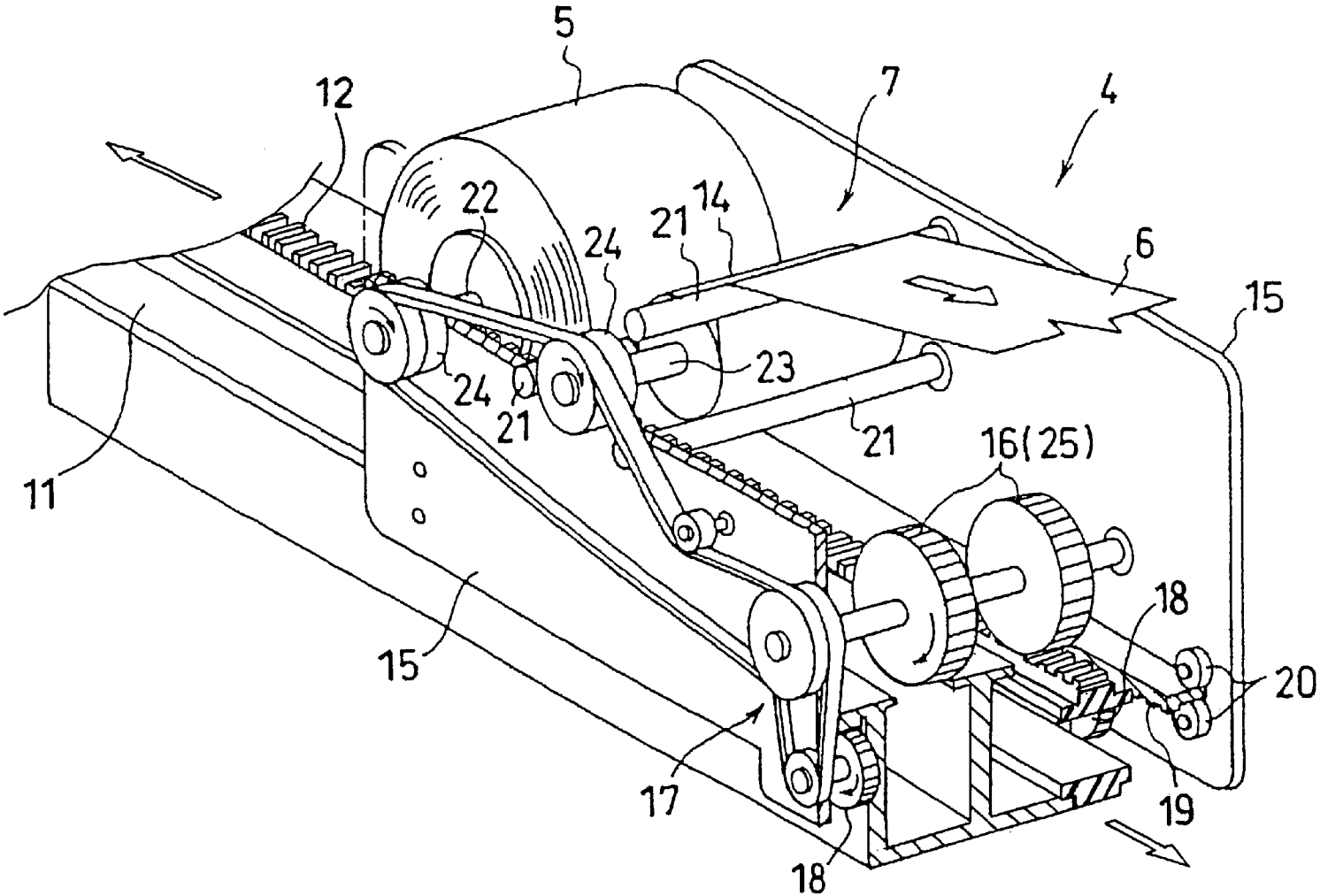

Because the above-mentioned serrated toothed belts (12) are each set along the whole inner surface of each of the U-shaped half-frames (3*a*), as shown in FIG. 1, if the openings (10) of both U-shaped half-frames (3*a*/3*a* ) touch each other, the two serrated toothed belts (12/12) are likely to interfere with each other in the openings (10). In this embodiment, therefore, the serrated toothed belt (12) is set in a grove on the opposite side, see FIG. 4, and both serrated toothed belts (12/12) do not interfere with each other. Therefore the passive gears (16) are set in two places between the side frame (15/15). Nevertheless, the means (12) of driving the truck, pertaining to the present invention, and the means of engaging with them, which are set in the truck (4) , are not limited to or by the structure described in this embodiment.

To smoothly guide the truck on the circular track (11), four holding rollers (20) are installed in the front and back in the inner surface of each side frames (15).

Between the side frames (15/15), as the means of feeding the packaging material, the packaging material coil (5), tension control roller (14) and three guide rollers (21 . . . ) are supported, each with mobility, and the packaging material (6), drawn from the packaging material coil (5), passes a route which curves between the tension control roller (14) and the three guide rollers (21. . . ) and is fed to the circumference of the steel plate wrapped coil, during which process the friction with the packaging material (6), which passes along the surface of the tension control roller (14), causes it to freely rotate.

When the truck (4) revolves along the circular track (11), the distance between the packaging material coil (5) and the position for wrapping the steel plate wrapped coil (8) periodically changes, but when this distance decreases, the drawing force of the packaging material (6) from the packaging material coil (5), or, in other words, the tension of the packaging material (6), weakens, and adequate wrapping cannot be conducted. Torque limiters (24/24) are therefore installed at the ends of the front side of the support axis (22) of the packaging material coil (5) and of the support axis of the tension control rollers respectively. Each torque limiters (24) is connected, with mobility, to the passive gear (16), which becomes the drive generator (25), via transmission mechanism (17), so that a rotary force in the direction opposite to the direction in which the packaging material (6) is fed can be applied by the passive gear (16) to the packaging material coil (5) and tension control roller (14).

If packaging material coil (5) and tension control roller (14) rotate at a rotary force which exceeds a set value, through the drawing of the packaging material (6), the torque limiter (24) interrupts the rotary force produced by the drive generator (25), so that the packaging material (16) is smoothly drawn. In addition, in it the rotary force produced by the above-mentioned drawing decreases below a set value, the interruption is removed and the rotary force produced by the drive generator (25) is applied so that the slackened packaging material (6) is rewound and the tension increased.

In addition, because the external diameter (of the packaging material coil (5)) decreases with the consumption of the packaging material (6), the rotary force in the opposite direction, which rotates the packaging material coil (5) via the torque limiter (24), initially can only resist a small drawing force. Nevertheless, because the rotary force in the opposite direction, which rotates the packaging material coil (5), is aimed at eliminating slack in the packaging material between the packaging material coil (5) and the tension control roller (14), there is no problem even when the tension changes.

On the other hand, because the external diameter of the tension control rollers (14) is constant, the rotary force which rotates the tension control rollers (14) is not affected by the consumption of the packaging material (6), and tension higher than a predetermined one can be applied to the packaging material (6) wrapped around the steel plate wrapped coil (8).

In the above-mentioned embodiment, the explanation refers to the packaging of a steel plate wrapped coil, but, needless to say, the invention can also be applied to packaging of other items for packaging, such as steel bundles. In the case that a long steel bundle is packaged, for example, packaging can be done by spirally wrapping the packaging material, by causing the truck to revolve while the steel bundle is gradually moved in a direction perpendicular to the page.

Moreover, the mechanism which maintains the tension of the packaging material above a set value can be applied also in the case that the means of feeding the packaging material is stationary and the item for packaging is caused to freely rotate. However, as shown in the above-mentioned embodiment, in the case that the above-mentioned mechanism is utilized in a means of feeding the packaging material, which is mounted on a truck which revolves along a circular track, the tension of the packaging material can be maintained by a simple and compact structure, the truck can be miniaturized and the whole packaging device can be miniaturized.

What is claimed is:

1. A packaging device, comprising:

a stationary closed track constructed so that at least one part thereof can open and close;

a truck movably mounted on the track;

a packaging material feeder mounted on the truck and constructed to feed a packaging material from a packaging material coil rotatably mounted on the truck;

a support arranged to support an item for packaging so that at least a part of said item is arranged in the closed track;

a drive mechanism installed along and moveable relatively to the track, said drive mechanism being linked to the truck for driving the truck along the track; and a motor mounted adjacent to the track in a stationary position to move the drive mechanism and thereby the truck;

wherein the truck comprises distinct first and second link elements via which the truck is linked to the drive mechanism and mounted on the track, respectively.

2. The device of claim 1, wherein the truck further comprises a transmission mechanism connecting the first and second link elements so that a first movement of the first link element, which is caused by a movement of the drive mechanism, is transmitted to and causes a second movement of the second link element, which causes the truck to travel along the track.

3. The device of claim 2, wherein the first link element includes a passive gear wheel.

4. The device of claim 2, wherein the second link element includes a driving gear wheel.

5. The device of claim 4, wherein the track comprises a rack with which the driving gear wheel engages.

6. The device of claim 2, wherein the drive mechanism includes a serrated toothed belt and the first link element includes a passive gear wheel engaging with the serrated toothed belt.

7. The device of claim 6, wherein the second link element includes a driving gear wheel, and the track comprises a rack with which the driving gear wheel engage.

8. The device of claim 7, wherein teeth of the serrated toothed belt face upwardly to engage with the passive gear wheel while teeth of the rack face downwardly to engage with the driving gear wheel.

9. The device of claim 2, wherein the track includes at least two track portions and the drive mechanism includes at least two separate drive units each installed along one of said two track portions.

10. The device of claim 9, wherein the first link element includes at least two gears each engaged with only one of said two drive units corresponding to one of the track portions which the truck is on.

11. The device of claim 9, wherein said two drive units comprise at least two endless drive units moving in at least two parallel planes.

12. A packaging device, comprising:

a stationary closed track constructed so that at least one part thereof can open and close;

a truck movably mounted on the track;

a packaging material feeder mounted on the truck and constructed to feed a packaging material from a packaging material coil rotatably mounted on the truck;

a support arranged to support an item for packaging so that at least a part of said item is arranged in the closed track;

a drive mechanism installed along and moveable relatively to the track, said drive mechanism being linked to the truck for driving the truck along the track; and a motor mounted adjacent to the track in a stationary position to move the drive mechanism and thereby the truck;

wherein the truck has a movable element via which the truck is linked to the drive mechanism.

13. The device of claim 12, wherein the movable element is a gear wheel engaged with the drive mechanism.

14. A packaging device, comprising:

a stationary closed track constructed so that at least one part thereof can open and close;

a truck movably mounted on the track;

a packaging material feeder mounted on the truck and constructed to feed a packaging material from a packaging material coil rotatably mounted on the truck;

a support arranged to support an item for packaging so that at least a part of said item is arranged in the closed track;

a drive mechanism installed along and moveable relatively to the track, said drive mechanism being linked to the truck for driving the truck along the track; and a motor mounted adjacent to the track in a stationary position to move the drive mechanism and thereby the truck;

wherein the track includes at least two track portions and the drive mechanism includes at least two separate drive units each installed along one of said two track portions.

15. The device of claim 14, wherein the truck includes at least two gears each engaged with only one of said two drive units corresponding to one of the track portions which the truck is on.

16. The device of claim 14, wherein said two drive units comprise at least two endless drive units moving in at least two parallel planes.

* * * * *